US008256518B2

(12) United States Patent
Guven et al.

(10) Patent No.: US 8,256,518 B2
(45) Date of Patent: Sep. 4, 2012

(54) FAIL AS IS MECHANISM AND METHOD

(75) Inventors: Oguzhan Guven, Houston, TX (US); Seth Conaway, Houston, TX (US); Ricardo Martinez, Spring, TX (US); Frank Coss, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 246 days.

(21) Appl. No.: 12/695,754

(22) Filed: Jan. 28, 2010

(65) Prior Publication Data

US 2010/0206579 A1 Aug. 19, 2010

Related U.S. Application Data

(60) Provisional application No. 61/153,671, filed on Feb. 19, 2009.

(51) Int. Cl.
*E21B 34/06* (2006.01)
*E21B 34/00* (2006.01)

(52) U.S. Cl. ..... 166/331; 166/319; 166/373; 166/374

(58) Field of Classification Search ..... 166/373, 166/374, 319, 331
See application file for complete search history.

(56) References Cited

U.S. PATENT DOCUMENTS

| | | | |
|---|---|---|---|
| 3,095,926 | A | 7/1963 | Rush |
| 3,249,124 | A | 5/1966 | Berryman |
| 3,280,917 | A | 10/1966 | Kisling |
| 3,308,882 | A | 3/1967 | Lebourg |
| 3,308,887 | A | 3/1967 | Nutter |
| 3,323,360 | A | 6/1967 | Nutter |
| 3,324,952 | A | 6/1967 | Berryman |
| 3,519,075 | A | 7/1970 | Mullins |
| 4,355,685 | A | 10/1982 | Beck |
| 4,403,659 | A | 9/1983 | Upchurch |
| 4,650,001 | A | 3/1987 | Ringgenberg |
| 4,714,116 | A | 12/1987 | Brunner |
| 5,310,013 | A | 5/1994 | Kishino |
| 5,529,126 | A | 6/1996 | Edwards |
| 5,617,926 | A | 4/1997 | Eddison |
| 5,667,025 | A | 9/1997 | Haessly |
| 6,302,216 | B1 | 10/2001 | Patel |
| 6,328,109 | B1 | 12/2001 | Pringle |
| 6,502,640 | B2 | 1/2003 | Rayssiguier |
| 6,523,613 | B2 | 2/2003 | Rayssiguier |
| 6,691,785 | B2 | 2/2004 | Patel |
| 6,776,239 | B2 | 8/2004 | Eslinger |
| 6,840,336 | B2 | 1/2005 | Schaaf |
| 6,889,771 | B1 | 5/2005 | Leising |
| 6,892,816 | B2 | 5/2005 | Pringle |

(Continued)

*Primary Examiner* — Brad Harcourt
(74) *Attorney, Agent, or Firm* — Brandon S. Clark

(57) ABSTRACT

A technique enables failsafe control over actuators used to actuate downhole tools. The technique may utilize a well system having a tool with an adjustable member. An actuation mechanism serves as a fail-as-is mechanism and works in cooperation with the adjustable member. The actuation member is shiftable upon receiving a predetermined input; however the actuation member does not move the adjustable member upon each shift. Once the actuation member has been shifted the requisite number of times to move the adjustable member to another position, at least one subsequent shift of the actuation member is not able to cause movement of the adjustable member. The result is a fail-as-is technique for ensuring the tool is not inadvertently actuated to another operational position.

16 Claims, 4 Drawing Sheets

U.S. PATENT DOCUMENTS

| | | | |
|---|---|---|---|
| 7,036,600 | B2 | 5/2006 | Johnson |
| 7,051,812 | B2 | 5/2006 | McKee |
| 7,066,264 | B2 | 6/2006 | Bissonnette |
| 7,090,020 | B2 | 8/2006 | Hill |
| 7,303,020 | B2 | 12/2007 | Bishop |
| 7,607,487 | B2 | 10/2009 | Lucas |
| 2007/0251697 | A1 | 11/2007 | Loretz |
| 2007/0295514 | A1 | 12/2007 | Rohde |
| 2009/0050335 | A1 | 2/2009 | Mandrou |
| 2009/0242199 | A1 | 10/2009 | Basmajian |

FAIL AS IS MECHANISM AND METHOD

CROSS-REFERENCE TO RELATED APPLICATION

The present document is based on and claims priority to U.S. Provisional Application Ser. No. 61/153,671, filed 19 Feb., 2009, the contents of which are herein incorporated by reference.

BACKGROUND

The following descriptions and examples are not admitted to be prior art by virtue of their inclusion in this section.

Inline barrier valves are used in downhole well applications. Accidental and inadvertent closing or opening of these valves can cause catastrophic failures. For example, inline lubricator valves are used to balance pressure while running an intervention tool downhole. If a failure occurs that results in an inadvertent opening or closing of the valve, substantial risk arises with respect to damage to equipment and/or injury to personnel.

SUMMARY

In general, embodiments of the present disclosure provide a technique for enabling failsafe control of actuators used to actuate downhole tools, such as downhole valves. According to one embodiment, a well system may comprise a tool having an adjustable member. An actuation mechanism serves as a fail-as-is mechanism and works in cooperation with the adjustable member. The actuation member is shiftable upon receiving a predetermined input; however the actuation member does not move the adjustable member upon each shift. Once the actuation member has been shifted the requisite number of times to move the adjustable member to another position, at least one subsequent shift of the actuation member is not able to cause movement of the adjustable member. This provides a fail-as-is technique for ensuring the tool, e.g. valve, is not inadvertently actuated to another operational position.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following description, numerous details are set forth to provide an understanding of the present disclosure. However, it will be understood by those of ordinary skill in the art that embodiments of the present disclosure may be practiced without these details, and that numerous variations or modifications from the described embodiments may be possible. In the specification and appended claims: the terms "connect", "connection", "connected", "in connection with", "connecting", "couple", "coupled", "coupled with", and "coupling" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention.

Embodiments of the present disclosure generally relate to a well system and well devices employing a failsafe control. According to one embodiment, the well system comprises a well tool and an actuation mechanism which cooperates with the well tool to move or shift the well tool between operational positions. The actuation mechanism is designed and serves as a fail-as-is mechanism that reduces or eliminates the risk of inadvertent actuation of the well tool.

According to one specific example, the well tool comprises a valve coupled in cooperation with the actuation mechanism. The actuation mechanism is designed as a fail-as-is mechanism that allows the valve to remain in a current position if there is a failure in a control mechanism, such as a loss of hydraulic pressure in a control line maintaining the valve in an open position. The fail-as-is mechanism also enables the tool, e.g., valve, to remain in a current position in the case of a related component failure. If the valve is in an open position when the component failure occurs, for example, the valve remains open. Similarly, if the valve is in the closed position when the failure occurs, the valve remains closed.

The tool and its actuation mechanism may have a variety of forms for use with a variety of overall well systems. In one well system embodiment, the tool comprises a valve deployed in an intervention tool. The valve may comprise a lubricator valve deployed in the intervention tool to balance pressure as the intervention tool is run downhole into a wellbore. The fail-as-is mechanism prevents inadvertent shifting of the valve to another operational position even if a control line or other valve component fails during run-in of the intervention tool.

Figure 1:
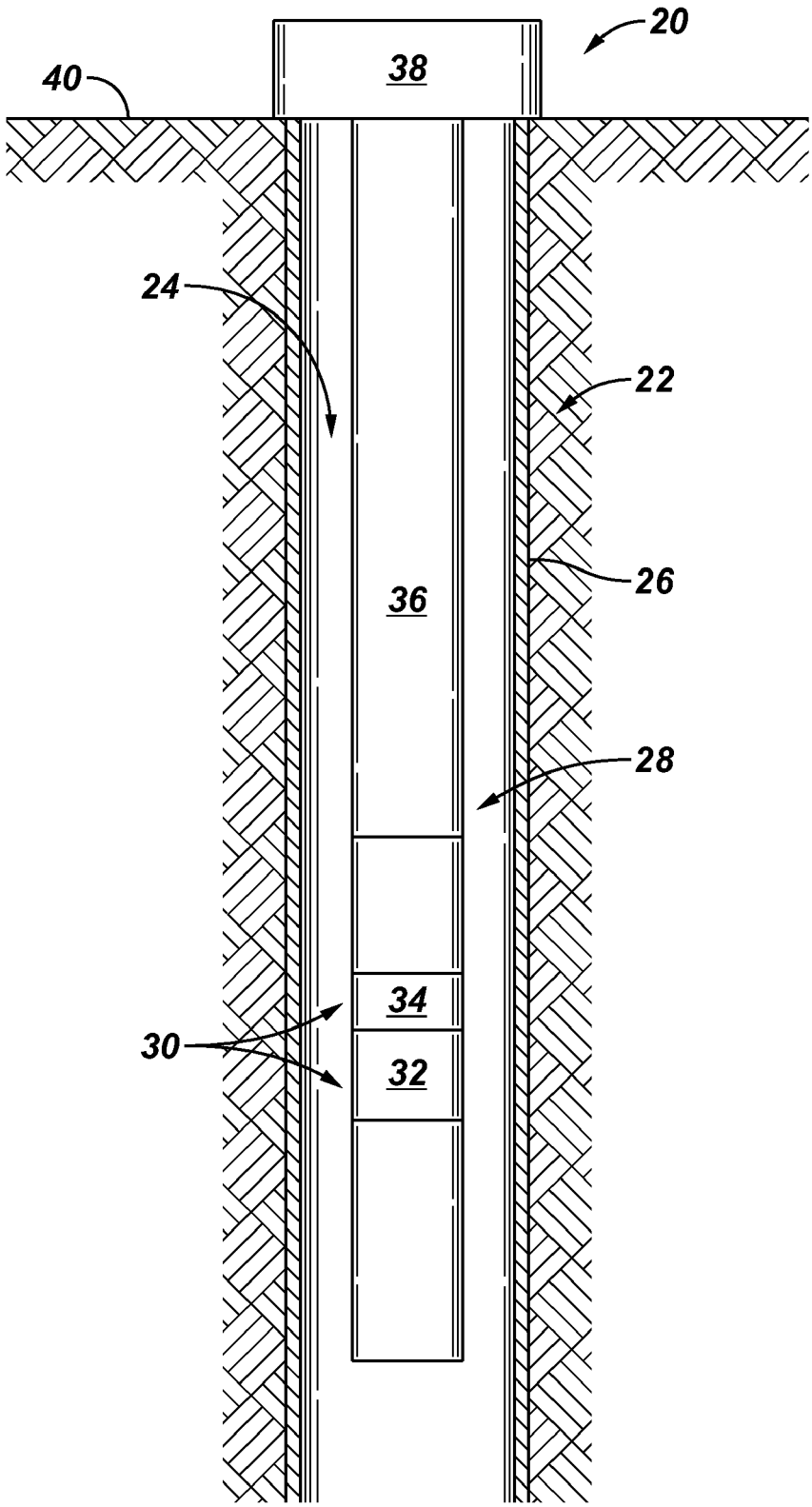
FIG. 1 is a schematic illustration of a well with a well system incorporating an actuation/fail-as-is mechanism, according to an embodiment of the present disclosure.

Referring generally to FIG. 1, a well system 20 is illustrated, according to one embodiment of the present disclosure. In the example illustrated, a well 22 comprises a wellbore 24 which may be lined with a casing 26, although in other situations the wellbore may be either an open, or partially cased wellbore. In this example, the well system 20 comprises a well string 28 having a variety of operational components 30. The specific types of operational components 30 depend on the well operation to be performed. Well string 28 further comprises a well tool 32 that may be moved/shifted between operational positions via an actuation mechanism 34. In this example, actuation mechanism 34 comprises a fail-as-is mechanism to help prevent inadvertent actuation of the well tool 32 to another operational position.

The well string 28 may be deployed downhole by a conveyance 36 which may have a variety of forms, such as production tubing, coiled tubing, cable, or other suitable conveyances. The conveyance 36 is used to deliver well string 28 and its well tool 32 downhole to a desired location in a wellbore 24. Generally, conveyance 34 is delivered downhole beneath surface equipment 38 positioned at a surface location 40. By way of example, surface equipment 38 may comprise a wellhead and/or rig equipment. In one specific example, the well string 28 comprises an intervention tool system, and well tool 32 is a valve, such as a lubricator valve. It also should be noted that the illustrated wellbore 24 is a generally vertical wellbore, however the system and methodology also may be utilized in deviated, e.g. horizontal, wellbores.

Figure 2:
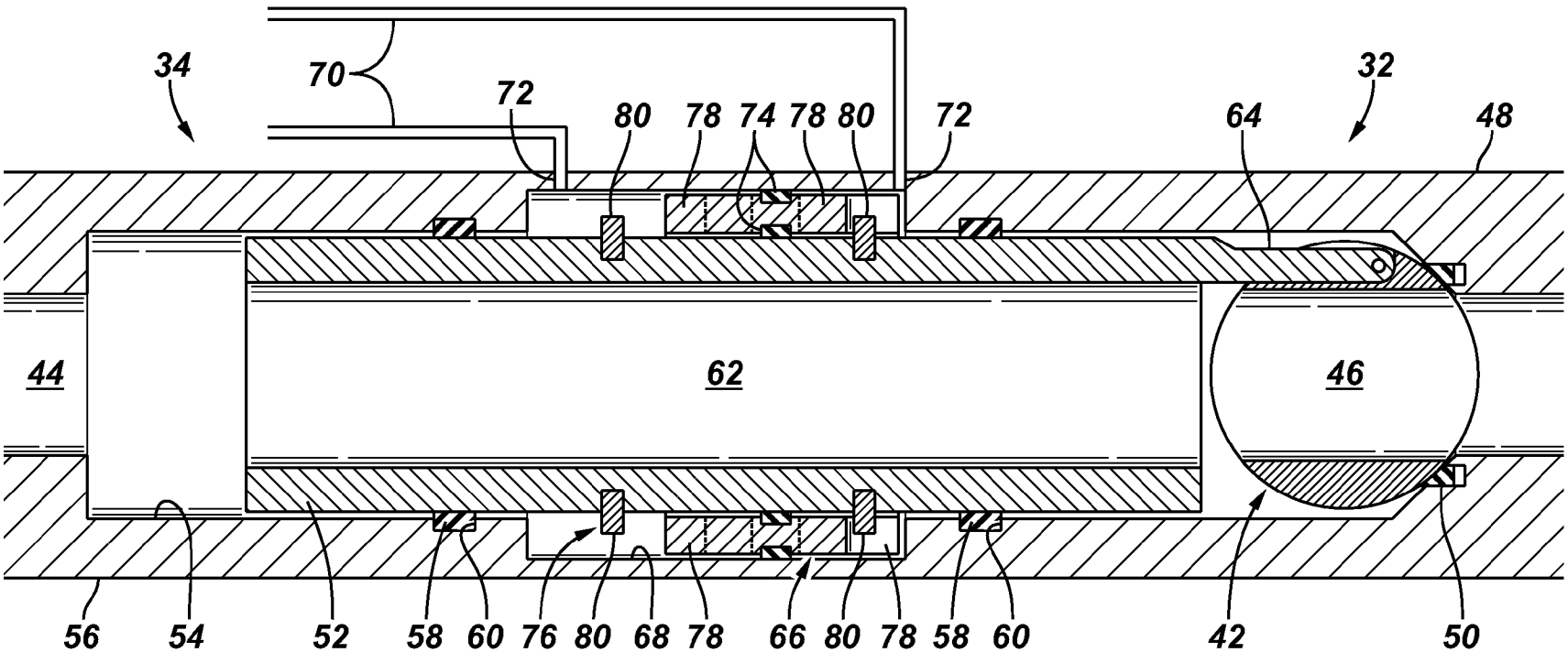
FIG. 2 is a cross-sectional view of one example of a fail-as-is mechanism coupled with a well tool, according to an embodiment of the present disclosure.

Referring generally to FIG. 2, one exemplary embodiment of well tool 32 and the cooperating actuation mechanism 34 is illustrated. In this embodiment, well tool 32 comprises a movable member 42 that may be moved between operational positions. Although well tool 32 may comprise a variety of tools, the illustrated well tool example comprises a valve, and movable member 42 comprises a valve member movable/shiftable between operational flow positions. Well tool 32 may comprise an inline barrier valve, for example, in which movable valve member 42 is movable between a closed position and an open position. The open position allows fluid flow through a primary flow passage 44 extending through well tool 32 and actuation mechanism 34.

In the embodiment illustrated in FIG. 2, movable member 42 is a ball valve member having an interior flow passage 46. The ball valve member 42 is pivotably mounted in a surrounding valve housing 48 against a ball seal 50. Ball valve member 42 is pivoted against ball seal 50 between an open position, allowing flow along flow passage 44 and interior flow passage 46, and a closed position blocking flow along flow passage 44. In FIG. 2, the movable member/ball 42 is illustrated in the open flow position.

The movable member 42 is coupled into cooperation with the actuation mechanism 34, which serves as a fail-as-is mechanism. As illustrated, actuation mechanism 34 comprises a mandrel 52 translatably mounted in a cylinder 54 defined by an actuation mechanism housing 56. Although valve housing 48 and actuation mechanism housing 56 may be formed as separate housings, the illustrated embodiment shows the valve housing 48 and actuation mechanism housing 56 as a single integral housing.

Mandrel 52 is sealed with respect to the surrounding actuation mechanism housing 56 via a plurality of seals 58. By way of example, seals 58 may comprise circular seals mounted in corresponding grooves 60 formed circumferentially along the interior surface of actuation mechanism housing 56. The mandrel 52 also comprises a longitudinal passage 62 through which fluid may be conducted as it flows along flow passage 44. Mandrel 52 is coupled with movable member 42 via a suitable mandrel operator 64. If movable member 42 comprises a ball valve, as illustrated, mandrel operator 64 comprises a linkage configured to pivot the ball valve between open and closed positions as mandrel 52 translates back and forth in a longitudinal direction along cylinder 54.

Shifting of mandrel 52 back and forth within the actuation mechanism housing 56 may be achieved via actuation of a piston 66 cooperatively coupled with mandrel 52. Piston 66 is slidably mounted within a recessed region 68 that is recessed into an interior wall of actuation mechanism housing 56 at a location surrounding mandrel 52. A predetermined input may be applied to piston 66 to selectively shift the piston back and forth in recessed region 68. However, every transition of the piston 66 along recessed region 68 does not impart motion to mandrel 52, and at least one "dummy" shifting of piston 66 is provided between each actual movement of mandrel 52. In other words, the interaction of piston 66 and of mandrel 52 enables the actuation mechanism 34 to perform as a fail-as-is mechanism by limiting movement of mandrel 52 (and thus valve member 42) to specific shifts within a series of shifts. Effectively, piston 66 is decoupled from mandrel 52 in that movement of piston does not necessarily move mandrel 52.

The predetermined input applied to shift piston 66 may be in a variety of forms, such as electrical, electro-hydraulic, hydraulic, or other types of inputs. In the specific example illustrated, the input is a hydraulic input provided by one or more hydraulic lines 70. If hydraulic inputs are used, single hydraulic lines may be used to move piston 66 against a resilient member; or two or more hydraulic lines 70 may be employed to selectively move the piston 66 back and forth along recessed region 68. In the embodiment illustrated, for example, the predetermined hydraulic input is provided by a pair of hydraulic lines 70 with an individual hydraulic line positioned on each side of piston 66 to selectively move the piston back and forth.

The hydraulic lines 70 are located to deliver hydraulic fluid into recessed region 68 on opposite sides of piston 66 via ports 72 extending through housing 56. The piston 66 may comprise a plurality of seals 74 positioned to form a seal between piston 66 and mandrel 52 on one side of the piston; and between piston 66 and an interior surface defining recessed region 68 on a radially opposite side of the piston. Pressurized hydraulic fluid is selectively applied to each side of piston 66 to drive the piston back and forth in recessed region 68 and to ultimately shift mandrel 52, thereby moving the movable member 42 to another operational position.

For each shift of piston 66 that causes movement of mandrel 52 and movable member 42, at least one subsequent shifting of the piston 66 is not able to cause movement of the mandrel 52. In many applications, a plurality of subsequent shifts of the piston 66 may not move mandrel 52. These "dummy" shifts ensure actuation mechanism 34 functions as a fail-as-is mechanism and prevents inadvertent actuation of movable member 42 to another operational position. The selective movement of mandrel 52 under the influence of piston 66 is caused by a selective engagement mechanism 76, which enables cooperation between actuation mechanism 34 and well tool 32 without directly coupling piston 66 to mandrel 52.

Figure 3:
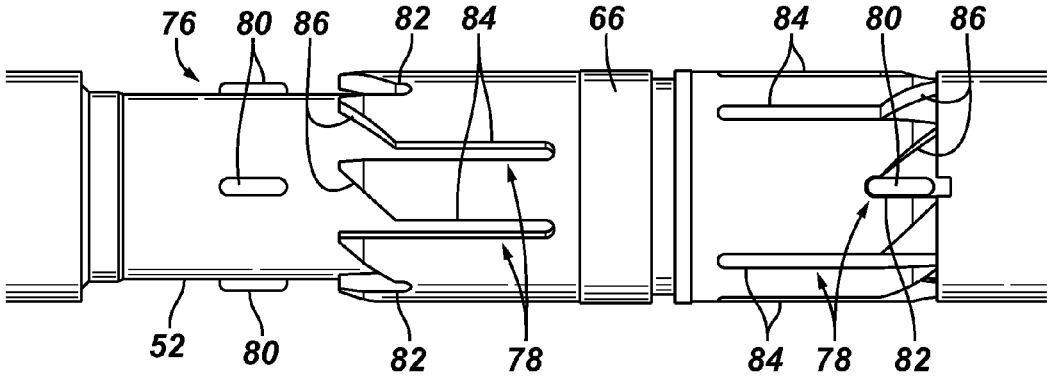
FIG. 3 is a front elevation view of one example of the fail-as-is mechanism illustrated in FIG. 2, according to an embodiment of the present disclosure.

According to one embodiment, selective engagement mechanism 76 is an indexer or indexing system in which piston 66 comprises a plurality of slots 78 that move in cooperation with corresponding keys 80 mounted on mandrel 52. In FIG. 3, one example of an indexing system 76 is illustrated in greater detail. In this example, piston 66 comprises the plurality of slots 78 formed by a series of short slots 82 and a series of long slots 84 which are longitudinally oriented along piston 66. By way of specific example, the indexing system may comprise a J-slot indexing system with at least one long J-slot 84 between each sequential pair of short J-slots 82 moving in a circumferential direction around piston 66. In the specific example, a plurality of long J-slots 84, e.g. two J-slots, is positioned between each sequential pair of short J-slots 82. Additionally, the piston 66 may have two sets of the plurality of slots 78 in which each set of slots is positioned at an opposed longitudinal end of piston 66. The slots 78 are oriented for engagement with corresponding sets of keys 80 mounted to mandrel 52, on both longitudinal ends of piston 66.

When the piston 66 is shifted, sloped surfaces 86 engage corresponding keys 80 and slightly rotate the piston 66 relative to the mandrel 52 so that the keys 80 move along the corresponding slots 78. If the keys 80 move into a short slot 82, continued movement of piston 66 forces a corresponding movement of mandrel 52. By having slots 78 on both longitudinal ends of piston 66, a similar engagement occurs as the piston 66 is shifted longitudinally in each direction. The engagement of keys 80 at one longitudinal end of the piston 66 effectively rotates the piston slightly for appropriate engagement with keys 80 at an opposite longitudinal end of the piston 66 when the piston 66 is transitioned in the opposite longitudinal direction. However, between each sequential pair of short slots 82, one or more long slots 84 prevent movement of the mandrel 52 during one or more subsequent shifts. This is accomplished by forming long slots 84 with sufficient length to prevent the "bottoming out" of keys 80 over the full longitudinal transition or stroke of piston 66.

As a result, the decoupling between piston 66 and mandrel 52 creates a fail-as-is mechanism that can be used in a variety of downhole tools. A few examples of suitable downhole tools include downhole completion tools, which may be in the form of valves, e.g. barrier valves, ball valves, safety valves, inflow control valves, as well as a variety of other tools. The unintended actuation of the downhole tool is prevented because the motion of piston 66 is decoupled from the mandrel 52 following the transition of mandrel 52. In the embodiment illustrated, movable member 42 is a ball valve movable via appropriate activation of selective engagement mechanism 76. The selective engagement mechanism 76 may be an index system comprising J-slots located on opposite longitudinal ends of the piston 66 such that each set of slots 78 is arranged in a pattern with short J-slots 82 separated by two long J-slots 84, for example.

In the embodiment illustrated, mandrel 52 has two sets of matching sized lugs or keys 80. When piston 66 moves through a full stroke along recessed region 68 and the subject mandrel keys 80 move into a long slot 84, the mandrel 52 does not move. On the other hand, if the mandrel keys 80 move into one of the short slots 82, the mandrel 52 moves according to the corresponding movement of the piston 66 as it transitions through its piston stroke. In the illustrated example, the movement of mandrel 52 cycles the valve member 42 between open and closed positions. After intentionally actuating the movable member 42, the subsequent, repeated cycling of piston 66 results in the next two piston strokes moving through two dummy cycles in which the mandrel keys 80 engage long slots 84. Accordingly, in the case of a failure, e.g. a control line leak, the next two cycles or strokes of piston 66 produce two non-activating movements which fail to move mandrel 52. This prevents inadvertent actuation of the downhole well tool 32.

In the embodiment illustrated in FIG. 2, the actuation mechanism 34 is a hydraulic actuation mechanism with a displacement based fail-as-is feature for selectively moving a ball type, downhole barrier valve while protecting the valve from inadvertent actuation. However, other embodiments of the fail-as-is feature may comprise other components, actuation techniques, and configurations for moving a variety of tools between operational positions while protecting the tool from inadvertent actuation. Furthermore, the series of actuations of piston 66 between each movement of movable member 42 may be selected according to the requirements of a specific application, well tool, and/or operator considerations. In the example illustrated, two long slots 84 are followed with a short slot 82, resulting in two "dead" cycles prior to actuating the well tool 32. The number of "dead" cycles in which the piston 66 does not actuate the mandrel 52 may be as few as one or as many as three or more depending on the specific application. In some cases, the "dead" cycles may only follow one of the operational sequences. For example, two operational cycles may occur sequentially followed by one or more "dead" cycles.

Figure 4:
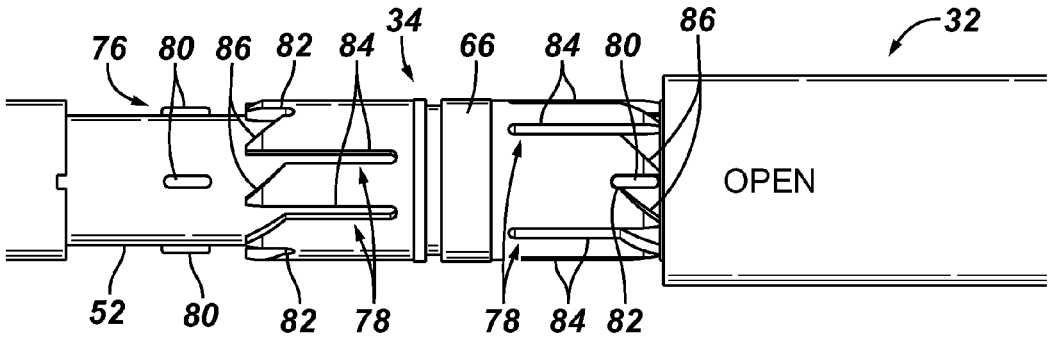
FIG. 4 is a schematic illustration of the fail-as-is mechanism and cooperating tool in an operational position, according to an embodiment of the present disclosure.

Referring generally to FIGS. 4-8, a series of actuation cycles is provided in sequential figures to help illustrate the cooperation of actuation mechanism 34 and well tool 32. The cooperation results in selective movement of the movable member 42, e.g. valve member, between operational positions while protecting the well tool from inadvertent actuation. In the illustrated sequence, the piston 66 is initially in a rightmost position and the keys 80 located on the right side of piston 66 are engaged with the short slots 82, as illustrated in FIG. 4. The piston 66 is illustrated as actuated through its full stroke to the right, thus transitioning mandrel 52 to the right side which, in turn, moves valve member 42 to an open position. (See FIG. 2).

Figure 5:
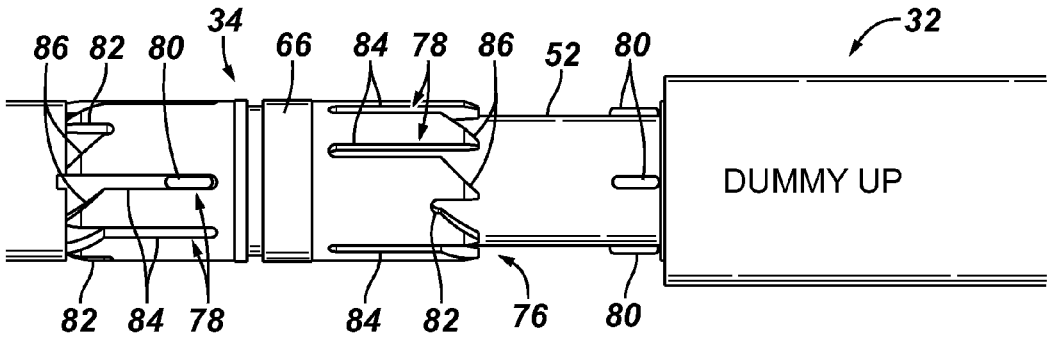
FIG. 5 is a schematic illustration of the fail-as-is mechanism and cooperating tool in another operational position, according to an embodiment of the present disclosure.
Figure 6:
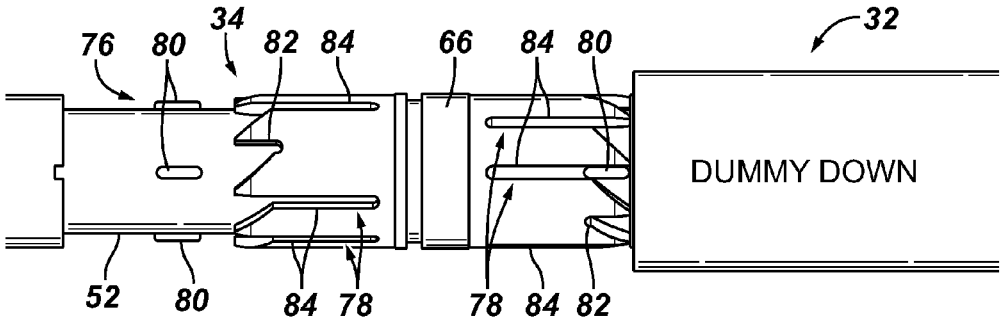
FIG. 6 is a schematic illustration of the fail-as-is mechanism and cooperating tool in another operational position, according to an embodiment of the present disclosure.

As described above, when selective engagement mechanism 76 comprises and indexing system, piston 66 and slots 78 may be partially rotated around the mandrel 52 during each engagement to allow progression from one cycle to the next. When the piston 66 is subsequently cycled or stroked to the left, the keys 80 located on the left side of piston 66 are engaged with long slots 84, as illustrated in FIG. 5. During this stroke of piston 66, the mandrel 52 does not move. In the example illustrated, this subsequent stroke is called the "dummy up" cycle. The next sequential cycle or stroke of the piston 66 is again to the right, but this stroke results in engagement of the keys 80 located on the right side of piston 66 with long slots 84, as illustrated in FIG. 6. This stroke is also a dummy stroke and may be referred to as a "dummy down" stroke, which again protects valve member 42 from inadvertent actuation to a next operational position, e.g. a closed position.

Figure 7:
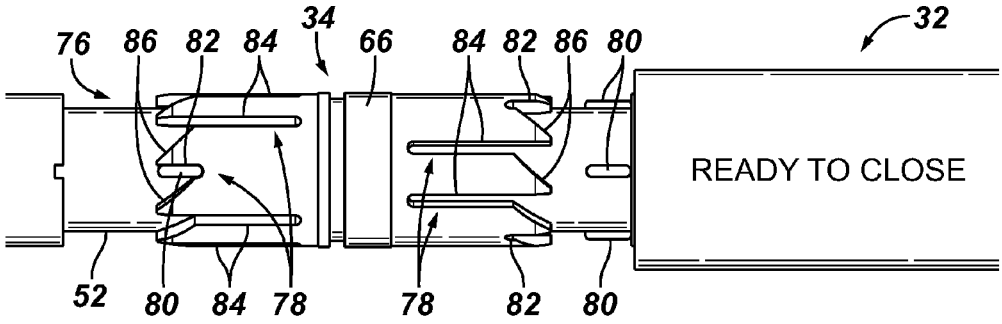
FIG. 7 is a schematic illustration of the fail-as-is mechanism and cooperating tool in another operational position, according to an embodiment of the present disclosure.
Figure 8:
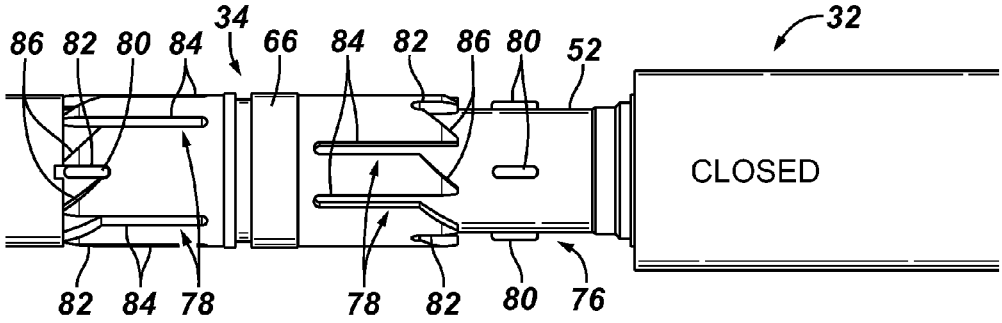
FIG. 8 is a schematic illustration of the fail-as-is mechanism and cooperating tool in another operational position, according to an embodiment of the present disclosure.

During the next actuation of piston 66, the piston is cycled or stroked to the left and the left keys 80 are engaged by short slots 82, as illustrated in FIG. 7. Continued movement of piston 66 through its full stroke, along recessed region 68, causes movement of the keys 80 and mandrel 52 toward the left, as illustrated in FIG. 8. This actuation of piston 66 and the resultant movement of mandrel 52 cause movement of valve member 42 to a subsequent operational position. In this particular example, the valve member 42 is transitioned from an open position to a closed position.

The fail-as-is feature of the actuation mechanism 34 protects the well tool against inadvertent actuation by providing at least one dummy cycle, e.g. two dummy cycles, between actual actuation steps. For example, after the ball valve is cycled open, the piston 66 is in the initial actuation position illustrated in FIG. 4. If one of the control lines 70 breaks and causes a pressure imbalance across piston 66, the piston may be actuated through the "dummy up" cycle. Because this cycle is a dummy cycle, the movable member 42, e.g. ball valve, is not actuated and remains in its current position. This same protection against inadvertent actuation also is provided when the movable member 42 is in a different operational position, e.g. when the ball valve is in a closed position. Again, if a control line 70 or other component breaks and creates a pressure imbalance across piston 66, the piston is simply moved through a dummy cycle and the movable member 42 remains in its current position. Accordingly, the actuation mechanism 34 serves as a fail-as-is mechanism that enables well tool actuation, while protecting the well tool from inadvertent actuation.

The overall well system 20 may be designed for use in a variety of well applications and well environments. Accordingly, the number, type and configuration of components and systems within the overall system may be adjusted to accommodate different applications. For example, the well tool and actuation mechanism may be employed in an intervention tool system or in a variety of other types of well systems. The technique for shifting actuation mechanism 34 may rely on a variety of predetermined inputs, such as hydraulic inputs, electrical inputs, electro-hydraulic inputs, and other inputs suitable for imparting motion to the shiftable piston. Furthermore, the piston, mandrel, selective engagement mechanism, and other components of the actuation mechanism may be adjusted to the specifics of a given well application and well tool. Similarly, the well tool may comprise a variety of valves and other types of well tools actuated between operational positions via various linkages between the actuation mechanism and the movable element of the well tool.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few embodiments of the present disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a downhole well system comprising an inline barrier valve having a valve member movable between closed and open flow positions, the downhole well system further comprising a fail-as-is mechanism coupled with the valve member and shiftable upon receiving a predetermined hydraulic input, the fail-as-is mechanism being limited to moving the valve member only on specific shifts in a series of shifts of the fail-as-is mechanism; wherein:

the fail-as-is mechanism comprises: a mandrel coupled with the valve member; and a piston to move the mandrel, the piston being decoupled from the mandrel such that every transition of a series of similar transitions of the piston does not move the mandrel;

the piston comprises a plurality of J-slots and the mandrel comprises a plurality of keys sized to slide along the J-slots, the plurality of J-slots having a short J-slot which allows the piston to move the mandrel and a long J-slot which prevents movement of the mandrel by the piston.

2. The system as recited in claim 1, wherein the fail-as-is mechanism moves the valve member on every third shift of the fail-as-is mechanism.

3. The system as recited in claim 1, wherein the piston must be transitioned back and forth a predetermined number of times between each movement of the mandrel and consequent movement of the valve member.

4. The system as recited in claim 1, wherein the predetermined hydraulic input is provided by a pair of hydraulic lines with a hydraulic line positioned on each side of the piston to selectively move the piston back and forth.

5. The system as recited in claim 1, wherein the valve member comprises a ball valve member pivotably mounted in a valve housing.

6. The system as recited in claim 1, wherein the downhole well system comprises an intervention tool.

7. The system as recited in claim 6, wherein the inline barrier valve is a pressure balancing valve operated to balance pressure acting on the intervention tool during running of the intervention tool downhole into the well.

8. A system for use in wellbore, comprising:

a well tool having an adjustable member; and an actuation mechanism cooperating with the adjustable member, the actuation mechanism being shiftable upon receiving a predetermined input to move the adjustable member to a different position, wherein at least one subsequent shift of the actuation mechanism upon receiving a subsequent predetermined input does not result in movement of the adjustable member; and wherein:

the adjustable member is a valve member;

the actuation mechanism comprises: a mandrel, coupled with the valve member; and a piston to move the mandrel, the piston being decoupled from the mandrel such that every transition of the a series of similar transitions of the piston does not move the mandrel;

the piston must be transitioned back and forth a predetermined number of times between each movement of the mandrel and consequent movement of the valve member; and the piston comprises a plurality of J-slots and the mandrel comprises a plurality of keys sized to slide along the J-slots, the plurality of J-slots having a short J-slot which allows the piston to move the mandrel and a long J-slot which prevents movement of the mandrel by the piston.

9. The system as recited in claim 8, wherein the actuation mechanism serves as a fail-as-is mechanism and only moves the adjustable member after cycling through a plurality of dummy shifts.

10. A fail-as-is mechanism, comprising:

an actuation device configured with an index system comprising a series of long J-slots and short J-slots;

a mandrel comprising two sets of keys configured to engage the long and short J-slots;

wherein repeated cycling of the actuation device results in one set of keys engaging the short J-slots, thereby causing the mandrel to move, while at least one of the next cycle does not cause the mandrel to move.

11. The fail-as-is mechanism recited in claim 10, wherein sequential short J-slots are separated by at least two long J-slots.

12. The fail-as-is mechanism recited in claim 10, further comprising a valve member coupled to the mandrel.

13. A method for operating a failure-as-is mechanism, comprising:

cycling pressure to an actuation device configured with an index system comprising a series of long J-slots and short J-slots until actuation of a mandrel to a first position;

cycling pressure to the actuation device for a predetermined number of times to cycle the actuation device through one or more dummy cycles in which the mandrel is not actuated; and cycling pressure to the actuation device an additional time to actuate the mandrel from the first position to a second position;

wherein keys provided on the mandrel engage with the index system of the actuation device such that actuation of the mandrel occurs when the keys engage the short J-slots.

14. The method as recited in claim 13, further comprising using the actuation device to open and close a valve.

15. The method as recited in claim 13, further comprising positioning a plurality of long J-slots between each sequential pair of short J-slots.

16. The method as recited in claim 13, wherein cycling pressure comprises cycling hydraulic pressure.

* * * * *